US011814234B1

(12) United States Patent
Moon

(10) Patent No.: US 11,814,234 B1
(45) Date of Patent: Nov. 14, 2023

(54) SNAP-FIT COOLER BOX

(71) Applicant: MILAGROS INTERNATIONAL INC., Taipei (TW)

(72) Inventor: Jerry Moon, Taipei (TW)

(73) Assignee: MILAGROS INTERNATIONAL INC., Taipei (TW)

( * ) Notice: Subject to any disclaimer, the term of this patent is extended or adjusted under 35 U.S.C. 154(b) by 0 days.

(21) Appl. No.: 17/944,607

(22) Filed: Sep. 14, 2022

(51) Int. Cl.
*B65D 81/38* (2006.01)
*B65D 45/16* (2006.01)

(52) U.S. Cl.
CPC ..... *B65D 81/3813* (2013.01); *B65D 45/16* (2013.01)

(58) Field of Classification Search
CPC ... Y10S 220/9152; A45C 11/20; B65D 81/38; B65D 81/3813; B65D 45/16; B65D 21/0228; B65D 2501/24675; B65D 2519/00567; B65D 5/6611; B65D 5/6647; B65D 5/6673; B65D 21/0204; B65D 2251/1025; B65D 2588/74; B65D 2588/743; B65D 3/22; B65D 9/02
See application file for complete search history.

(56) References Cited

U.S. PATENT DOCUMENTS 3,414,160 A * 12/1968 Weber ..... B65D 81/2038 220/203.18
4,899,904 A * 2/1990 Dooley ..... F25D 3/08 220/592.2
5,169,018 A * 12/1992 Fiore ..... A45C 13/28 220/756
6,244,458 B1 * 6/2001 Frysinger ..... F25D 3/125 220/592.2
8,875,934 B2 * 11/2014 Deka ..... B65D 81/3823 220/23.88
9,462,796 B1 * 10/2016 Ellis ..... A47C 7/62
9,878,841 B2 * 1/2018 Holderness ..... B65D 83/00
11,649,092 B2 * 5/2023 Mattila ..... E05C 19/14 220/324
2002/0117507 A1 * 8/2002 Doerfler ..... A45C 13/12 220/835
2003/0042264 A1 * 3/2003 Stanwix ..... F25D 23/065 220/592.21
2005/0029272 A1 * 2/2005 Padilla ..... B25H 3/02 220/735
2005/0103044 A1 * 5/2005 Mogil ..... A45C 11/20 220/592.2
2005/0279123 A1 * 12/2005 Maldonado ..... A45C 13/02 190/18 R (Continued)

*Primary Examiner* — Kareen K Thomas
(74) *Attorney, Agent, or Firm* — Rabin & Berdo, P.C.

(57) ABSTRACT

A snap-fit cooler box includes an outer shell, an inner shell, a plurality of inner snap-fit components, a plurality of outer snap-fit components, an insulating material and a cover. A closing end and an opening end are respectively formed on opposite sides of the outer shell; a container and a connecting flange are disposed on the inner shell. The inner snap-fit components are disposed between the closing end and the container, the outer snap-fit components are disposed between the opening end and the connecting flange. The inner and outer snap-fit components are used for allowing the inner shell to snap into the outer shell without using screws or nails. Therefore, the inner shell will not leak internal water to the exterior of the outer shell.

6 Claims, 17 Drawing Sheets

(56) References Cited

U.S. PATENT DOCUMENTS

| | | | | |
|---|---|---|---|---|
| 2011/0100992 | A1* | 5/2011 | Zhang | E05B 73/0023 220/324 |
| 2013/0207359 | A1* | 8/2013 | Vanderberg | A45C 11/20 280/30 |
| 2014/0034645 | A1* | 2/2014 | Jackson | B65F 1/141 248/689 |
| 2014/0216959 | A1* | 8/2014 | Raymus | B65D 81/3205 215/6 |
| 2015/0136786 | A1* | 5/2015 | Lonner | B65D 21/086 220/529 |
| 2017/0003063 | A1* | 1/2017 | Jackson | F25D 3/08 |
| 2017/0101301 | A1* | 4/2017 | Volin | F25D 31/006 |
| 2018/0186547 | A1* | 7/2018 | Morine | F25D 3/08 |

* cited by examiner

SNAP-FIT COOLER BOX

FIELD OF THE INVENTION

The present invention relates to a cooler box that can temporarily refrigerate food, especially a snap-fit cooler box that can improve the connection between components, thereby facilitating the manufacturer to assemble and effectively saving assembly time.

BACKGROUND OF THE INVENTION

Fishing and camping are the interests of many people, and generally fishing and camping enthusiasts will prepare cooler boxes to store fish, food or drinks and other items. However, at present, cooler boxes mainly have an outer shell, an inner shell and an insulating material, and the outer shell, the inner shell and the insulating material are assembled with each other through screws, so that the insulating material is located between the outer shell and the inner shell.

However, in the process of assembling the outer shell, inner shell and insulating material together through screws, the hands of the maker must simultaneously hold the outer shell, inner shell and insulating material at all times to ensure that the outer shell, inner shell and insulating material will not be misaligned during the process of assembling them together through screws. Otherwise, once the outer shell, inner shell and insulating material are misaligned, the outer shell, inner shell and insulating material may not be able to be firmly assembled together. Relatively, it takes extra time to disassemble and assemble again, thereby, the connection method in which the outer shell, inner shell and insulating material are assembled with each other through screws not only cannot shorten the processing time to improve the output, but even when the inner shell is filled with water, the water will leak from the inner shell to the outside of the outer shell along the screws.

SUMMARY OF THE INVENTION

The main purpose of the present invention is to improve the assembly method between the inner and outer shells in the cooler box, so as to not only reduce the difficulty of assembling the inner shell to the outer shell, but even when the inner shell is filled with water, the water will not leak from the inside of the inner shell to the outside of the outer shell.

The secondary purpose of the present invention is to improve the connection method of the handle to the outer shell or the inner shell, so that when the handle is swung relative to the outer shell or the inner shell, the handle can avoid detaching from the outer shell or the inner shell.

To achieve the above purposes, the present creation is mainly composed of an outer shell, an inner shell, an accommodating space, an insulating material, a cover, a plurality of inner snap-fit components and a plurality of outer snap-fit components.

A closing end and an opening end located opposite to the closing end, an inner shell being provided with a container locating inside the outer shell and a connecting flange locating outside the shell, then the accommodating space is formed between the outer shell and the inner shell.

The insulating material is located inside the accommodating space, and the cover is being pivoted with the connection flange, so that the container can be covered by the cover, wherein each of the inner snap-fit components includes two inner snapping hooks that can snap into each other, one of the inner snapping hooks are disposed on the closing end, and the other of the inner snapping hooks are disposed on the container; each of the inner snapping hooks includes an inner pillaring body and an inner buckling body extending from the inner pillaring body and an inner guide surface is formed on the inner buckling body of one of the inner snapping hooks to contact with another inner guide surface on the inner buckling body of the other of the inner snapping hooks, and each of the outer snap-fit components are disposed between the opening end and the connecting flange and includes an outer snapping block and an outer snapping hook that is capable of snapping into the outer snapping block, a hook guide surface is formed on the outer snapping hook to contact the outer snapping block.

In a preferred embodiment, a plurality of holes are penetratingly formed in a partial area of the insulating material for accommodating the inner snap-fit components; each of the holes has an inner sidewall surface, and a contour of the hole is larger than the inner snap-fit components, so that the inner sidewall surface is spaced out the inner snap-fit components.

In another preferred embodiment, the accommodating space is filled with the insulating material, so that the insulating material contacts with the outer shell, the inner shell and the inner snap-fit components simultaneously.

In the preceding two embodiments, when the inner buckling body of one of the inner snapping hooks contacts the another inner buckling body of the other of the inner snapping hooks, the inner pillaring body of the inner snapping hooks will deformed along two opposite directions at the same time, wherein a pivoting hole is formed on one of the outer shell and the inner shell for communicating with the accommodating space, and the snap-fit cooler box further comprises a handle, the handle incudes a grip portion and a pivoting portion forming on the grip portion for inserting the pivoting hole, and the pivoting portion is provided with a pin section and a block section; the contour of the pivoting hole is larger than the pin section, and the contour of the pivoting hole is smaller than the block section.

Finally, the inner snap-fit components are arranged in a rectangular pattern, so that a rectangular contour being formed by the inner snap-fit components is smaller than a supporting area of the closing end.

The present invention is characterized by the fact that the inner snap-fit components are disposed between the closing end of the outer shell and the container of the inner shell, and each of the outer snap-fit components is disposed between the opening end of the outer shell and the connecting flange of the inner shell, so that the inner shell is capable of snapping into the outer shell through the inner snap-fit components and the outer snap-fit components, thereby the manufacturer can not only assemble the inner shell to the outer shell conveniently, but even when the inner shell is filled with water, the water will not leak from the inside of the inner shell to the outside of the outer shell.

In addition, the block section is disposed on the pivoting portion of the handle, and the contour of the block section is larger than the pivoting hole, so that when the pivoting portion penetrates the pivoting hole, the block section can enter the accommodating space through the pivoting hole, and the block section can contacts the outer shell or the inner shell, so that when the handle is swung relative to the outer shell or the inner shell, the handle can avoid detaching from the outer shell or the inner shell by contacting the outer shell or the inner shell through the block section.

DETAILED DESCRIPTION OF THE PREFERRED EMBODIMENTS

Figure 1:
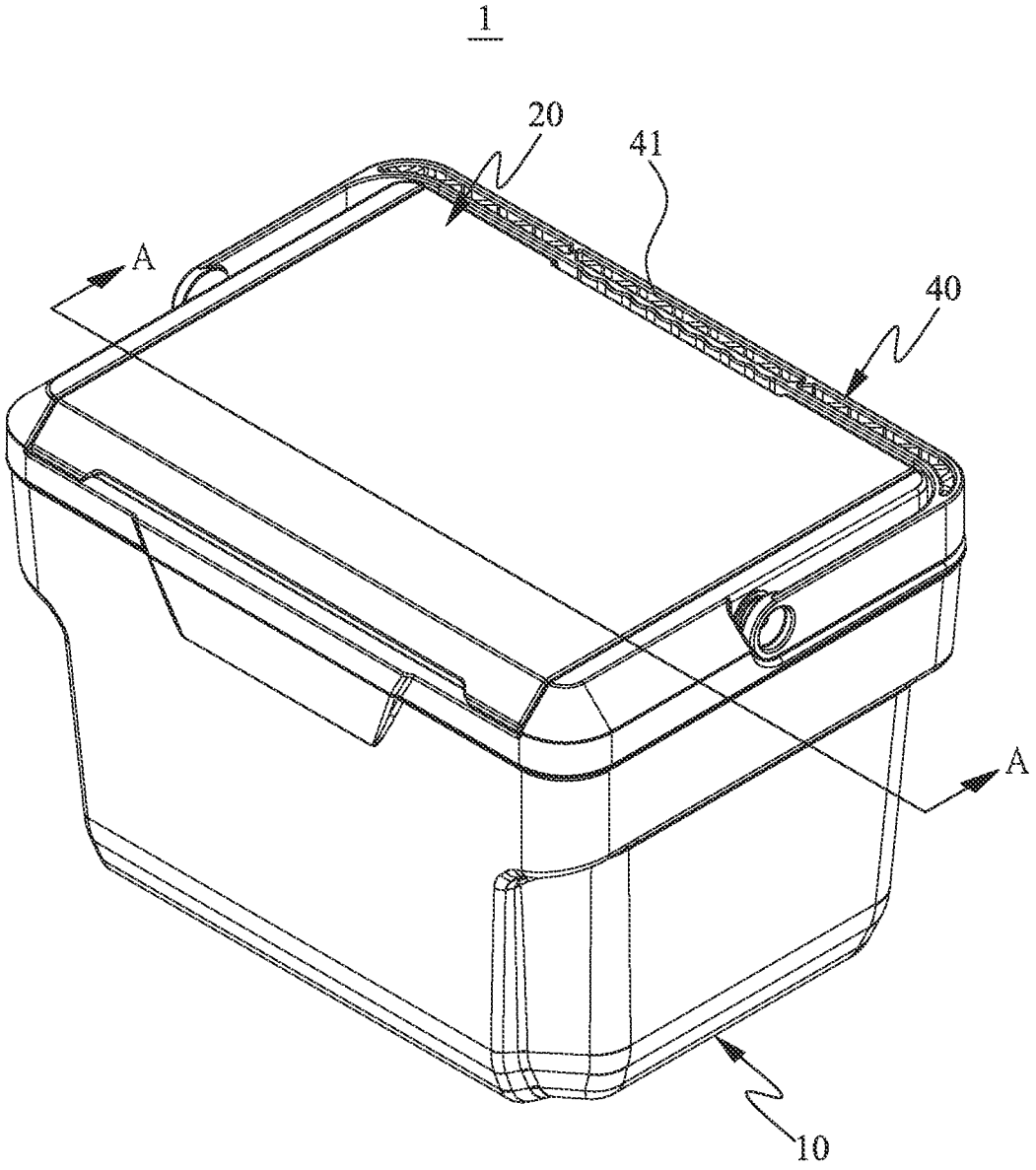
FIG. 1 shows a perspective view of a snap-fit cooler box according to the first preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
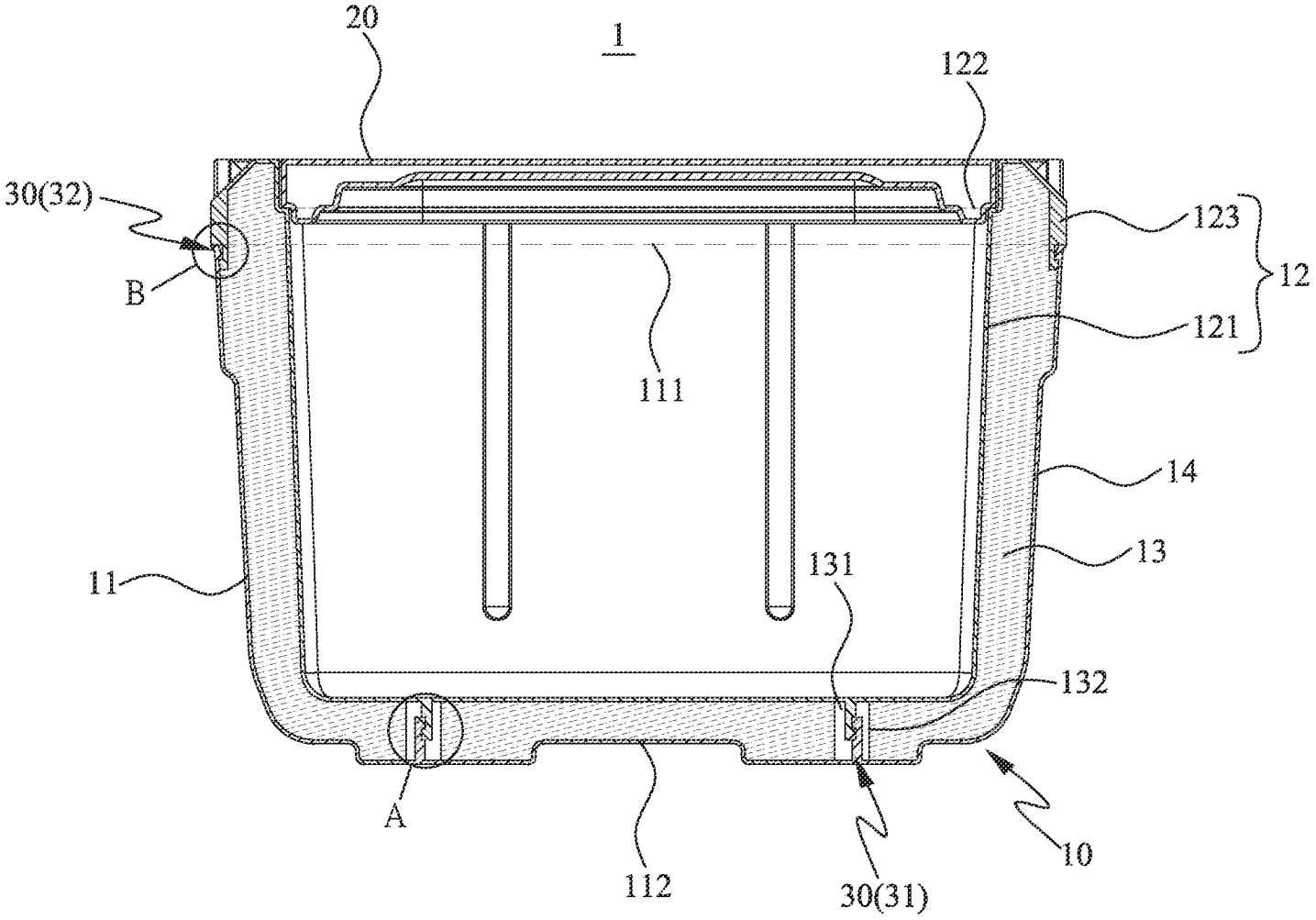
FIG. 2 shows a sectional view of the section A-A in FIG. 1.
Figure 3:
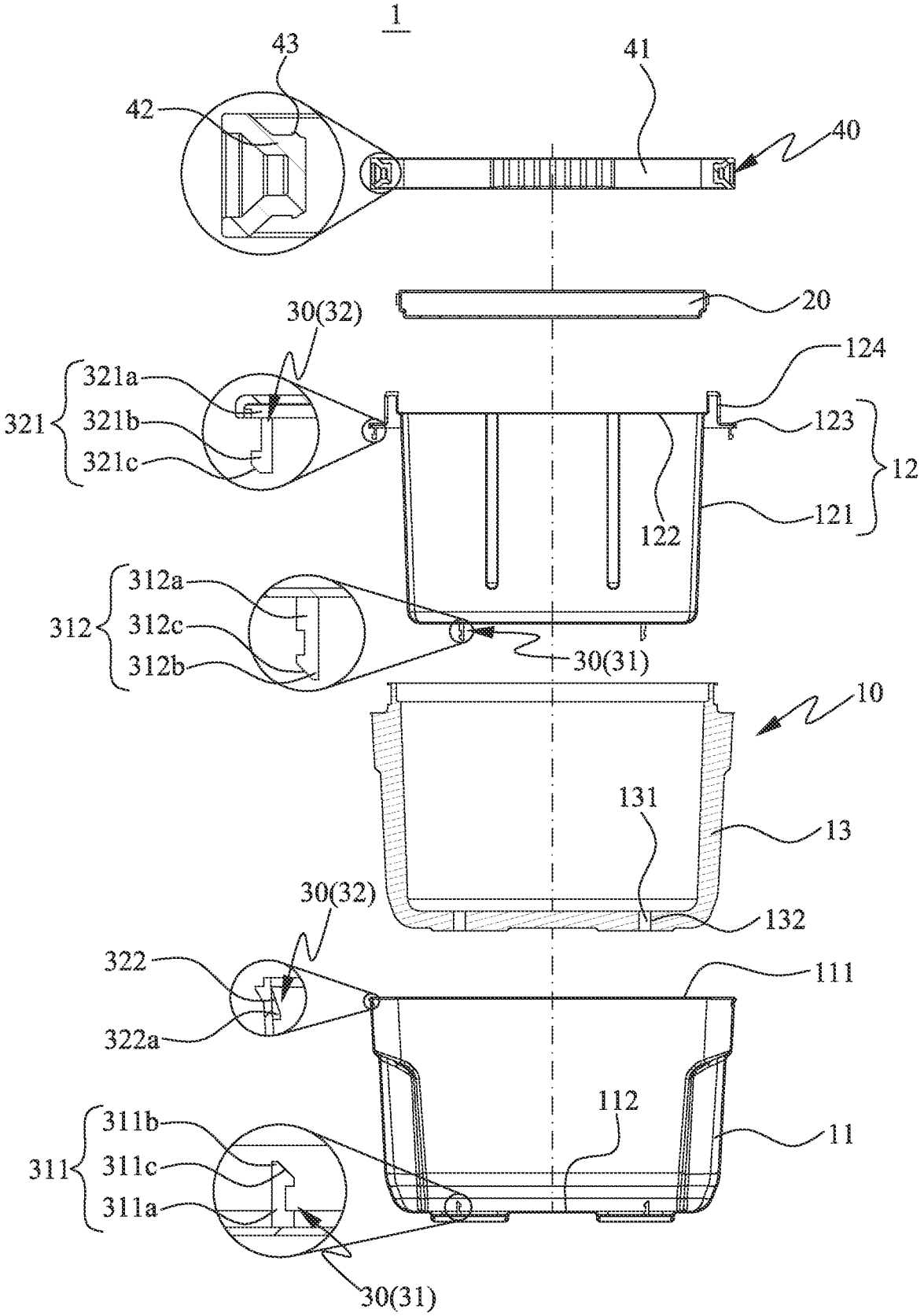
FIG. 3 shows a sectional exploded view of the snap-fit cooler box according to the first preferred embodiment of the present invention.
Figure 4:
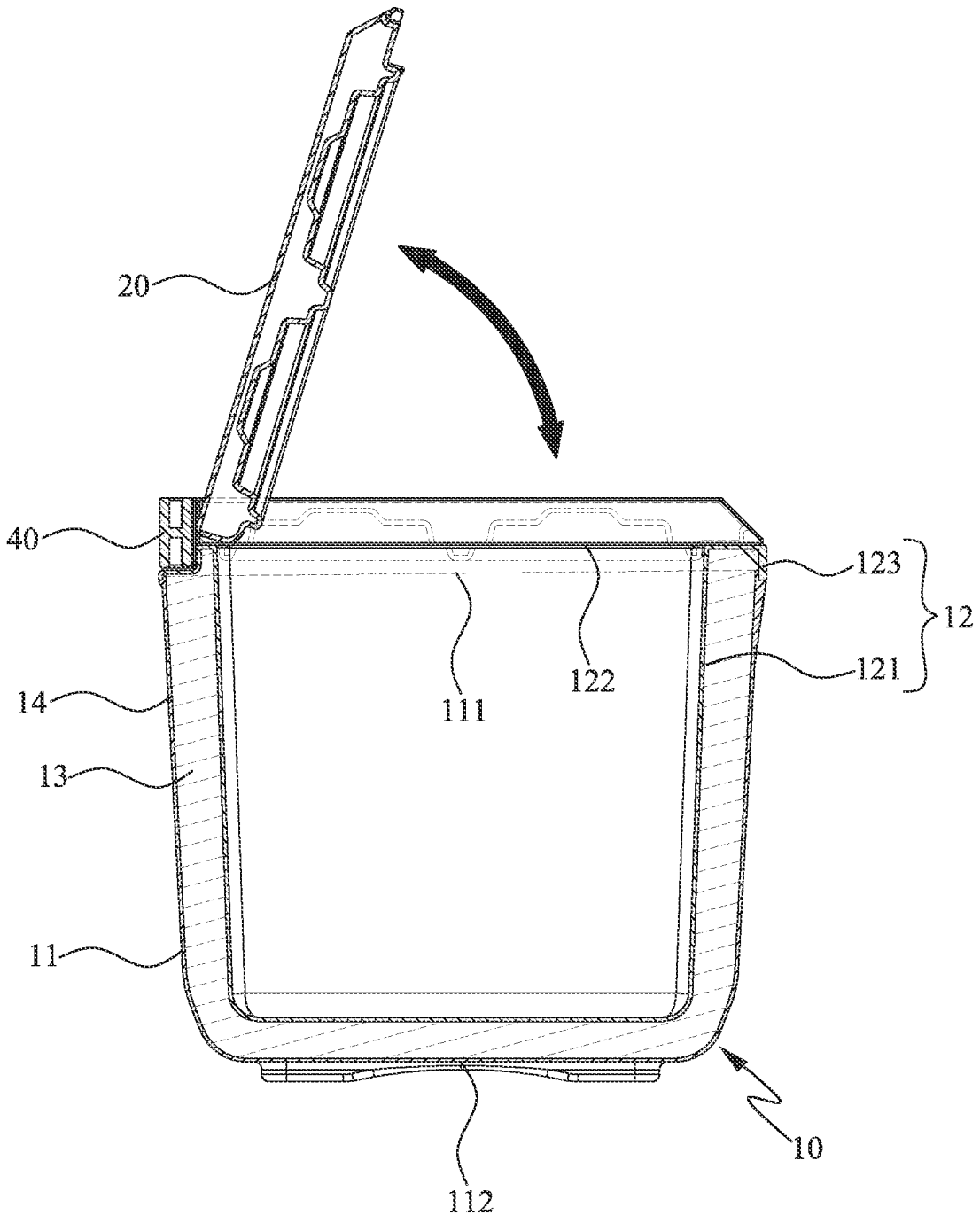
FIG. 4 shows a schematic diagram of a cover swinging relative to a box.

Referring to FIG. 1, FIG. 2 and FIG. 3, in this embodiment, a snap-fit cooler box 1 of the present invention comprises a box 10, a cover 20, a snap-fit mechanism and a handle 40, as shown in FIGs, the box 10 has three parts which are an outer shell 11, an inner shell 12 and an insulating material 13, wherein the outer shell 11 is in a hollow state, so that a top of the outer shell 11 is formed with an opening end 111 for communicating the interior of the outer shell 11, and a bottom of the outer shell 11 is formed with a closing end 112 spacing the opening end 111. Furthermore, a container 121 having a contour smaller than the opening end 111 and a containing opening 122 formed on one side of the container 121. The container 121 is a hollow state, so that the interior of the container 121 can be communicated with the containing opening 122, and the container 121 extends outward horizontally at the position of the containing opening 122 to form a connecting flange 123 with a contour larger than the opening end 111, and the opposite sides of the connecting flange 123 are respectively penetrated to form a pivoting hole 124.

As shown in FIG. 2 and FIG. 3, the container 121 of the inner shell 12 is located inside the outer shell 11 of the box 10, and because the contour of the connecting flange 123 of the inner shell 12 is larger than that of the opening end 111 of the outer shell 11, the connecting flange 123 will contacts the opening end 111, so that the connecting flange 123 is located on the outside of the outer shell 11, wherein when the container 121 is located inside the outer shell 11, an accommodating space 14 will be formed between the outer shell 11 and the inner shell 12, meanwhile, a bottom end of the container 121 is arranged on the closing end 112 of the outer shell 11 at intervals, so that a height position of the closing end 112 is lower than a bottom end of the container 121, furthermore, the insulating material 13 is located inside the accommodating space 14, so that the insulating material 13 is capable of covering an outer periphery of the container 121, as shown in FIGs, a plurality of holes 131 between the closing end 112 of the outer shell 11 and the container 121 of the inner shell 12 are disposed on the insulating material 13, and each of the plurality of holes 131 has an inner sidewall surface 132 inside. In this embodiment, the outer shell 11 and the inner shell 12 are made of Extruded Polyethylene (EPE).

Referring to FIG. 2 and FIG. 3, the cover 20 is located above the box 10, wherein the cover 20 is pivoted on the connecting flange 123 of the inner shell 12 so that cover 20 is capable of swinging back and forth relative to the box 10, and further the cover 20 can cover the containing opening 122 of the container 121.

Figure 5:
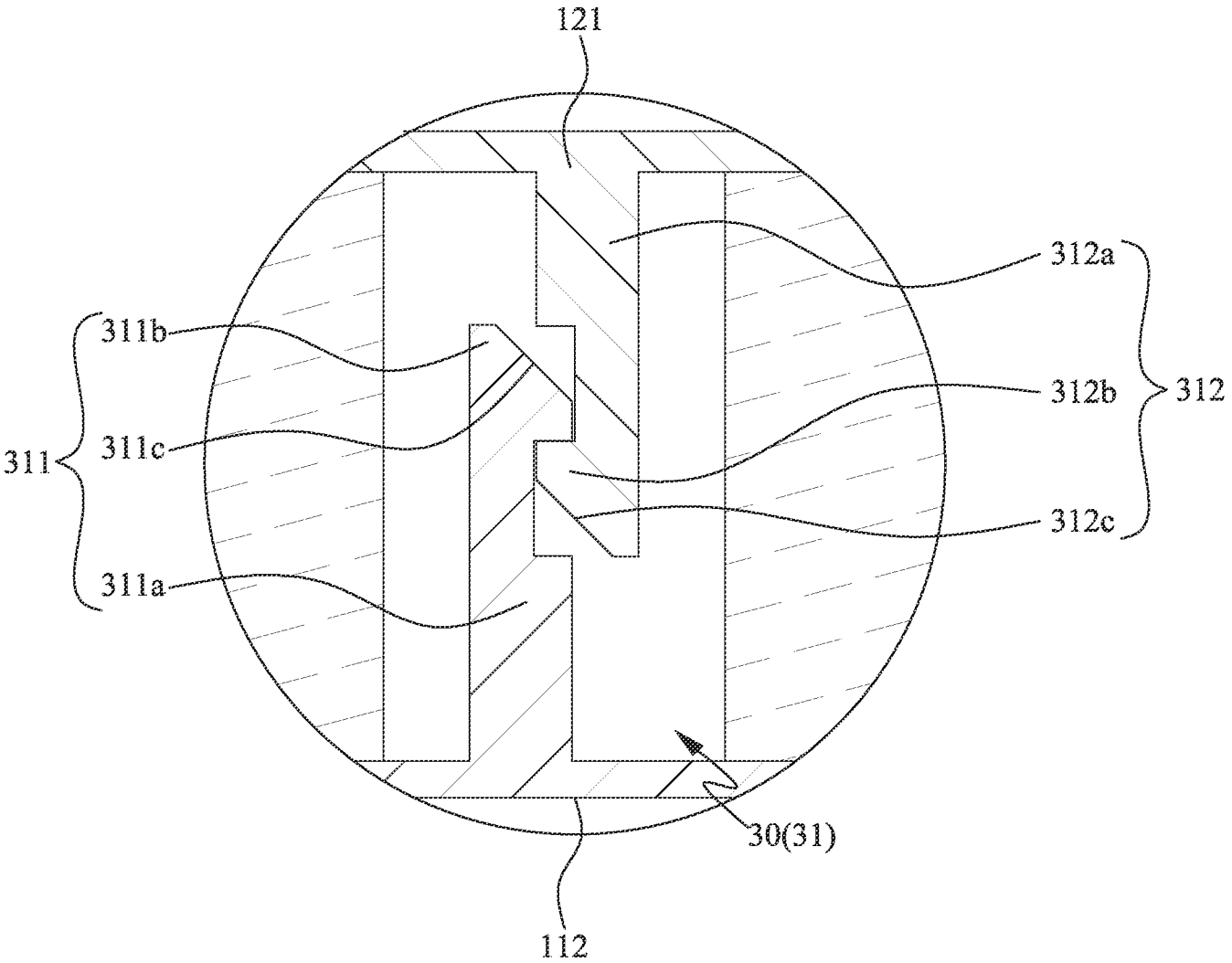
FIG. 5 shows an enlarged view of part A in FIG. 2.
Figure 6:
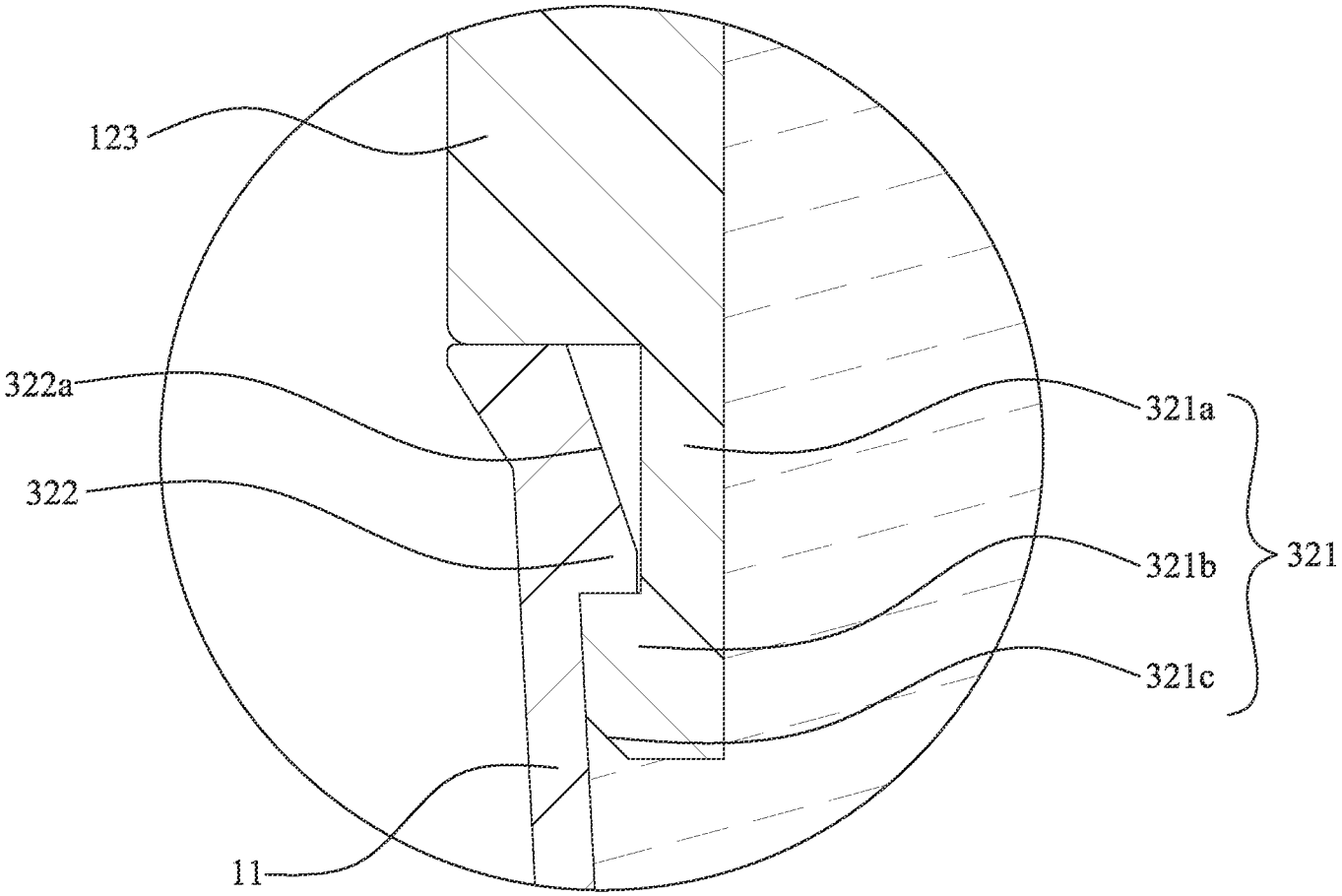
FIG. 6 shows an enlarged view of part B in FIG. 2.
Figure 7:
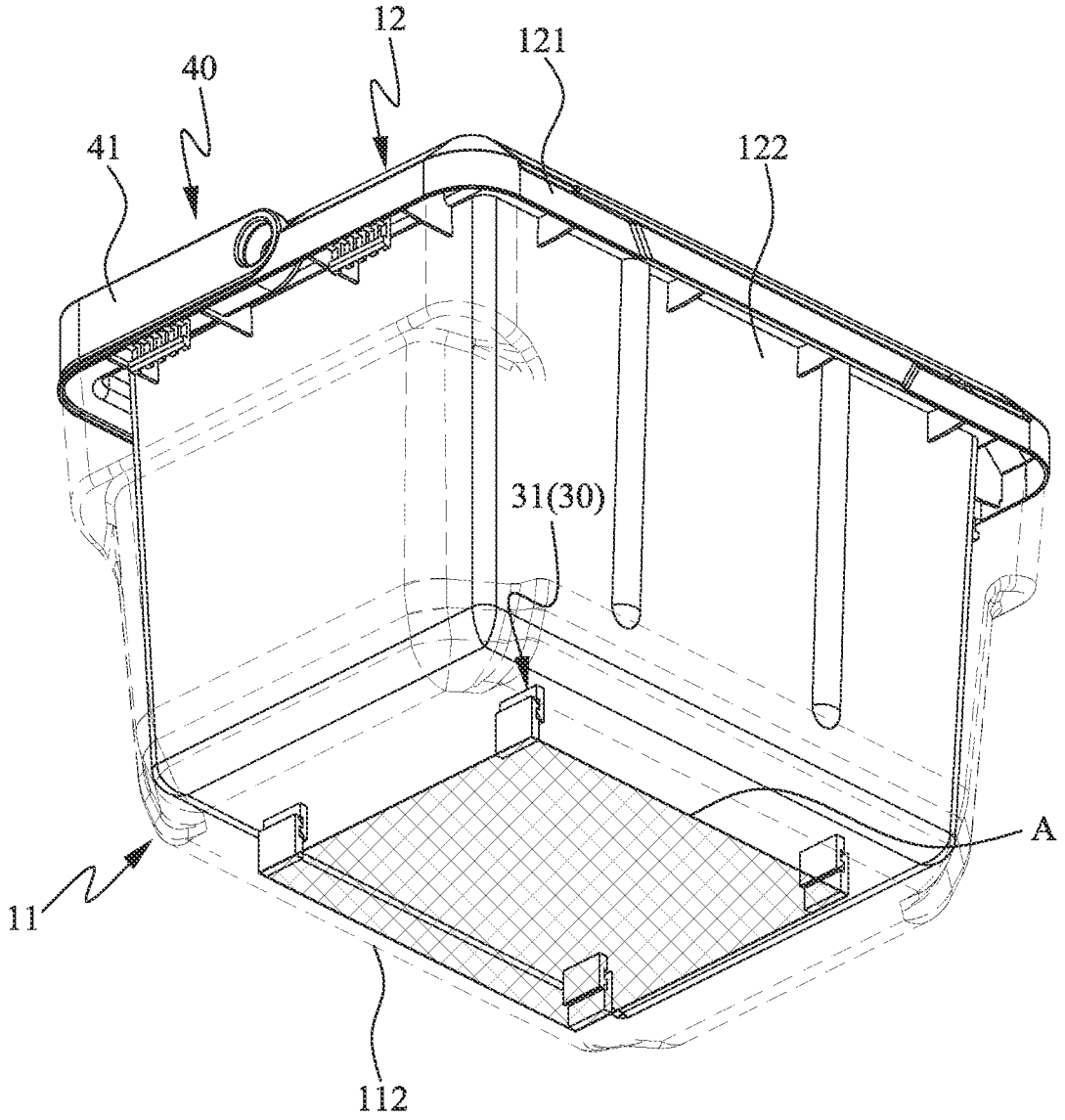
FIG. 7 is a schematic diagram showing a contour of a support area formed by a plurality of inner snap-fit components is smaller than a closing end.
Figure 8A:
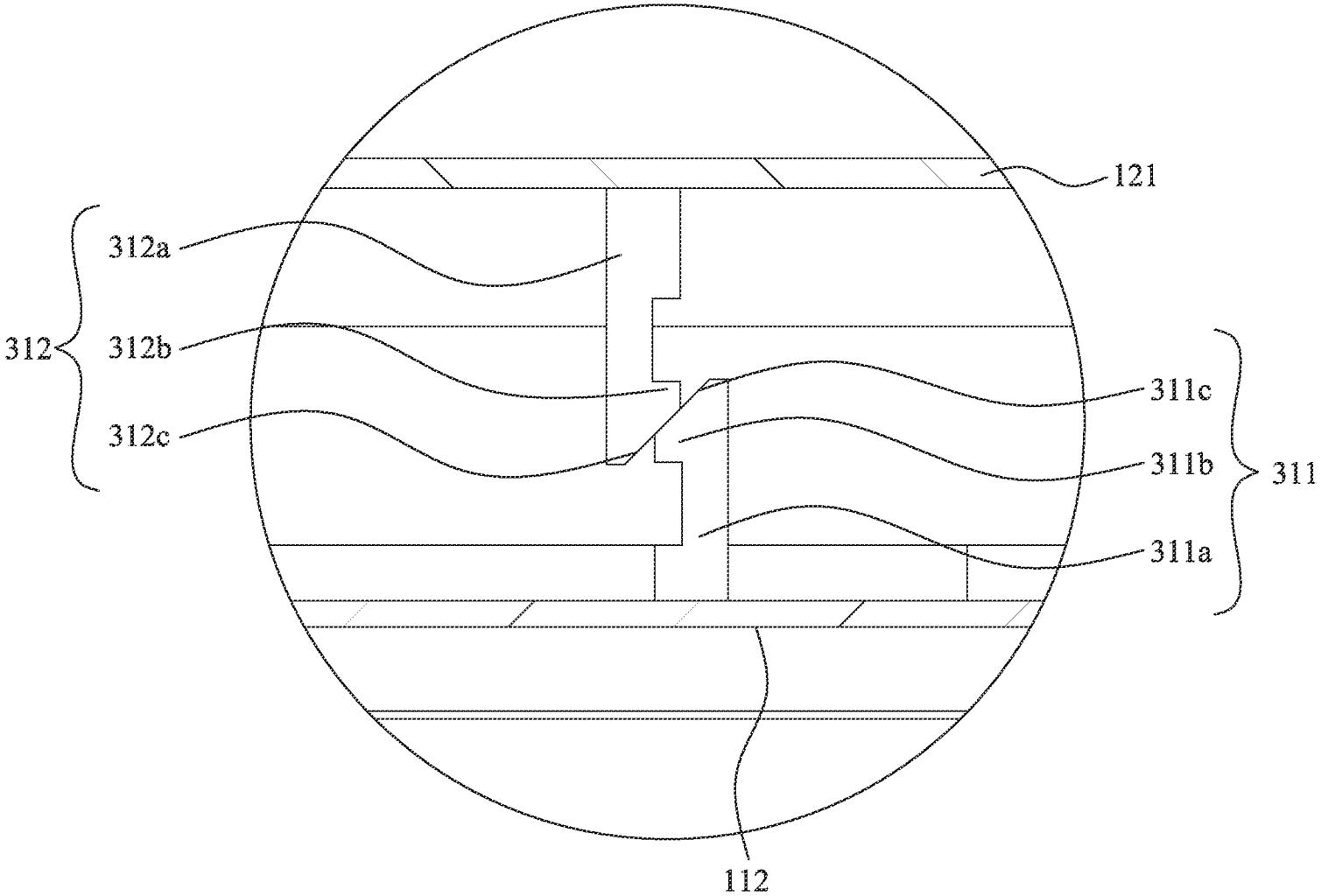
FIG. 8A is a schematic diagram showing a first inner snapping hook contacts to a second inner snapping hook.
Figure 8B:
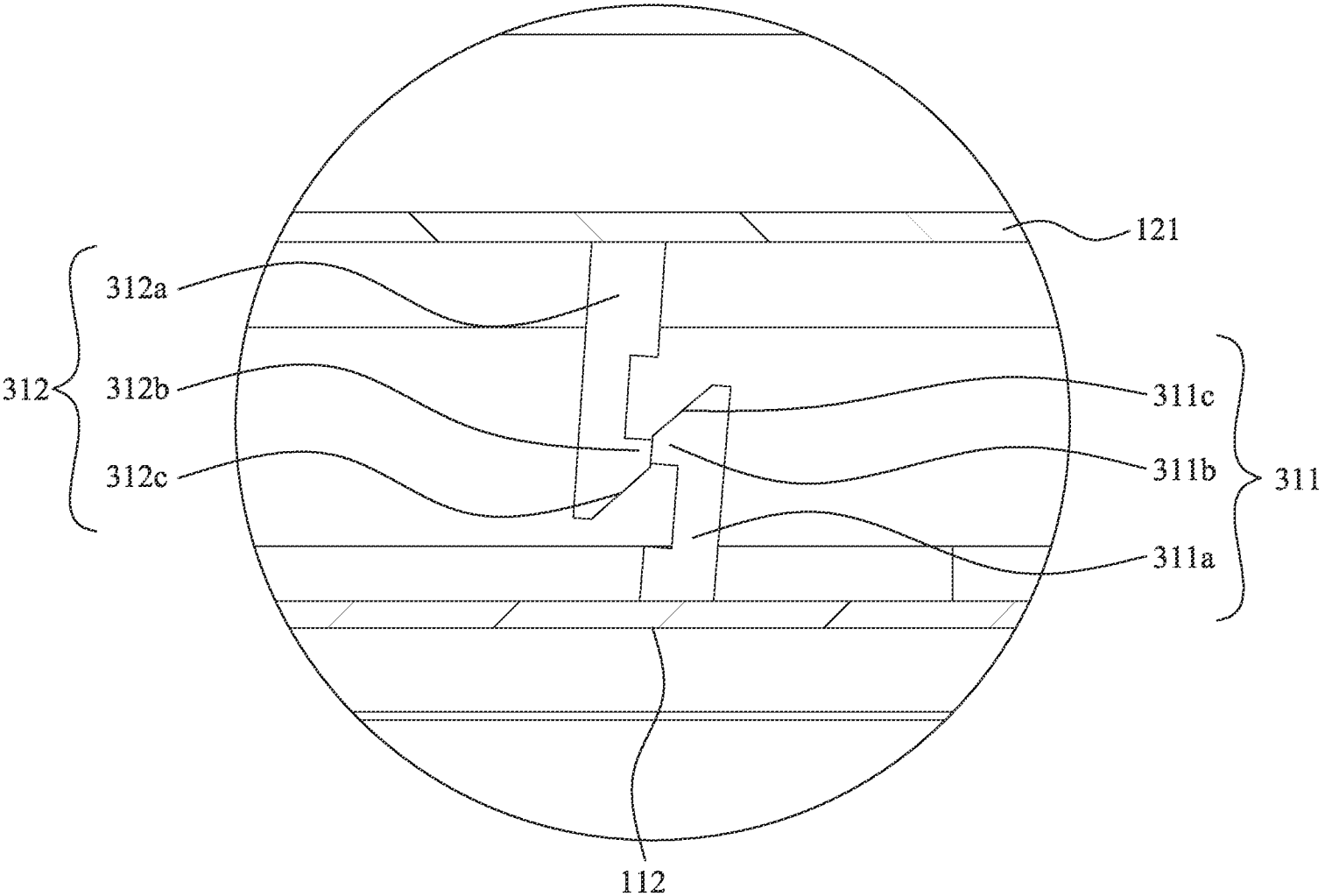
FIG. 8B is a schematic diagram showing the first inner snapping hook and the second inner snapping hook make a deformation at the same time.
Figure 8C:
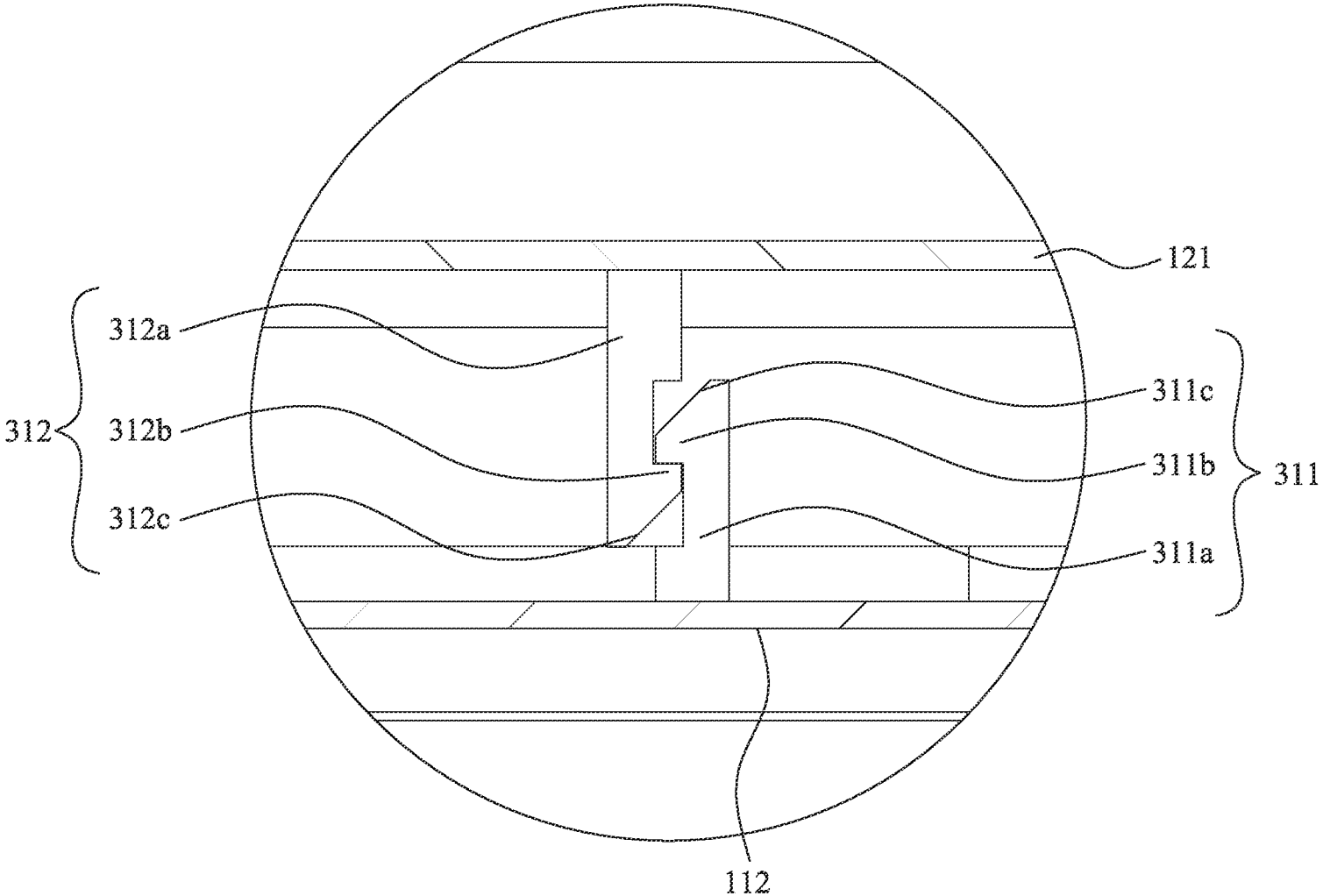
FIG. 8C is a schematic diagram showing the first inner snapping hook snaps into the second inner snapping hook.

Referring to FIG. 3, FIG. 5 and FIG. 6, the snap-fit mechanism 30 is used for making the outer shell 11 of the box 10 snap into the inner shell 12 of the box 10, and the snap-fit mechanism 30 has a plurality of inner snap-fit components 31 and a plurality of outer snap-fit components 32, as shown in FIG. 5, each of the plurality of inner snap-fit components 31 is located inside the hole 131 of the insulating material 13 one by one, so that the inner snap-fit components 31 are disposed between the closing end 112 of the outer shell 11 and the container 121 of the inner shell 12, in this embodiment, a contour of the hole 131 is larger than that of the inner snap-fit components 31, so that the inner sidewall surface 132 of the hole 131 is spaced apart from the inner snap-fit components 31, wherein the inner snap-fit components 31 has a first inner snapping hook 311 disposed on the closing end 112 and a second inner snapping hook 312 disposed on the container 121, wherein the first inner snapping hook 311 has a first inner pillaring body 311*a* formed by extending longitudinally from the closing end 112 and a first inner buckling body 311*b* formed by extending laterally from the first inner pillaring body 311*a*, and a first inner guide surface 311*c* in an inclined state is disposed on the first inner snapping hook 311 at the position of the first inner buckling body 311*b*, and the second inner snapping hook 312 has a second inner pillaring body 312*a* formed by extending longitudinally from the container 121 and a second inner buckling body 312*b* formed by extending laterally from the second inner pillaring body 312*a*, and a second inner guide surface 312*c* with the same inclination direction as that of the first inner guide surface 311*c* is disposed on the second inner snapping hook 312 at the position of the second inner buckling body 312*b*, as shown in FIG. 7, in this embodiment, the inner snap-fit components 31 are arranged along the front and rear directions of the inner shell 12 and the left and right directions of the inner shell 12, so that each of inner snap-fit components 31 is respectively located near the corner of the container 121, and the inner snap-fit components 31 are further arranged in a rectangular pattern, so that the inner snap-fit components 31 together form a support area A with a contour smaller than a supporting area of the closing end 112, furthermore, the outer snap-fit components 32 is disposed between the opening end 111 of the outer shell 11 and the connecting flange 123 of the inner shell 12, and the outer snap-fit components 32 has an outer snapping hook 321 formed in the connecting flange 123 and an outer snapping block 322 formed in the opening end 111, wherein the outer snapping hook 321 has an outer pillaring body 321*a* formed by extending longitudinally from the connecting flange 123 and an outer buckling block 321*b* extending laterally from the outer pillaring body 321, and a hook guide surface 321*c* in an inclined state is disposed on the outer snapping hook 321 at a position of the outer buckling block 321*b*, and a block guide surface 322*a* with the same inclination direction as that of the hook guide surface 321*c* is disposed on the outer snapping block 322. Referring to FIG. 8A, FIG. 8B and FIG. 8C, the inner shell 12 of the box 10 penetrates from the opening end 111 of the outer shell 11 to the inside of the outer shell 11, so that the container 121 of the inner shell 12 gradually approaches the closing end 112 of the outer shell 11, thereby, the second inner guide surface 312*c* of the second inner snapping hook 312 will first contacts the first inner guide surface 311*c* of the first inner snapping hook 311, then the inner shell 12 continues to move relative to the outer shell 11 in a state while the second inner guide surface 312*c* contacts the first inner guide surface 311*c*, so that the first inner pillaring body 311*a* of the first inner snapping hook 311 and the second inner pillaring body 312*a* of the second inner snapping hook 312 will deform in opposite directions at the same time through the contact of the first inner guide surface 311*c* with the second inner guide surface 312*c*, thereby, the first inner pillaring body 311*a* will be away from the second inner pillaring body 312*a*, at the same time, the contact area between the first inner guide surface 311*c* and the second inner guide surface 312*c* will be gradually reduced, and when the first inner guide surface 311*c* is not in contact with the second inner guide surface 312*c*, the first inner pillaring body 311*a* and the second inner pillaring body 312*a* will return to the original shape at the same time, so that the first inner buckling body 311*b* of the first inner snapping hook 311 is located above the second inner buckling body 312*b* of the second inner snapping hook 312, thereby, the first inner snapping hook 311 is snapped into the second inner snapping hook 312. Therefore, there are no screws or nails between the outer shell 11 and the inner shell 12, and the outer shell 11 and the inner shell 12 are made of Extruded Polyethylene (EPE), so as the outer shell 11 and the inner shell 12 can be recycled and reused.

Figure 9A:
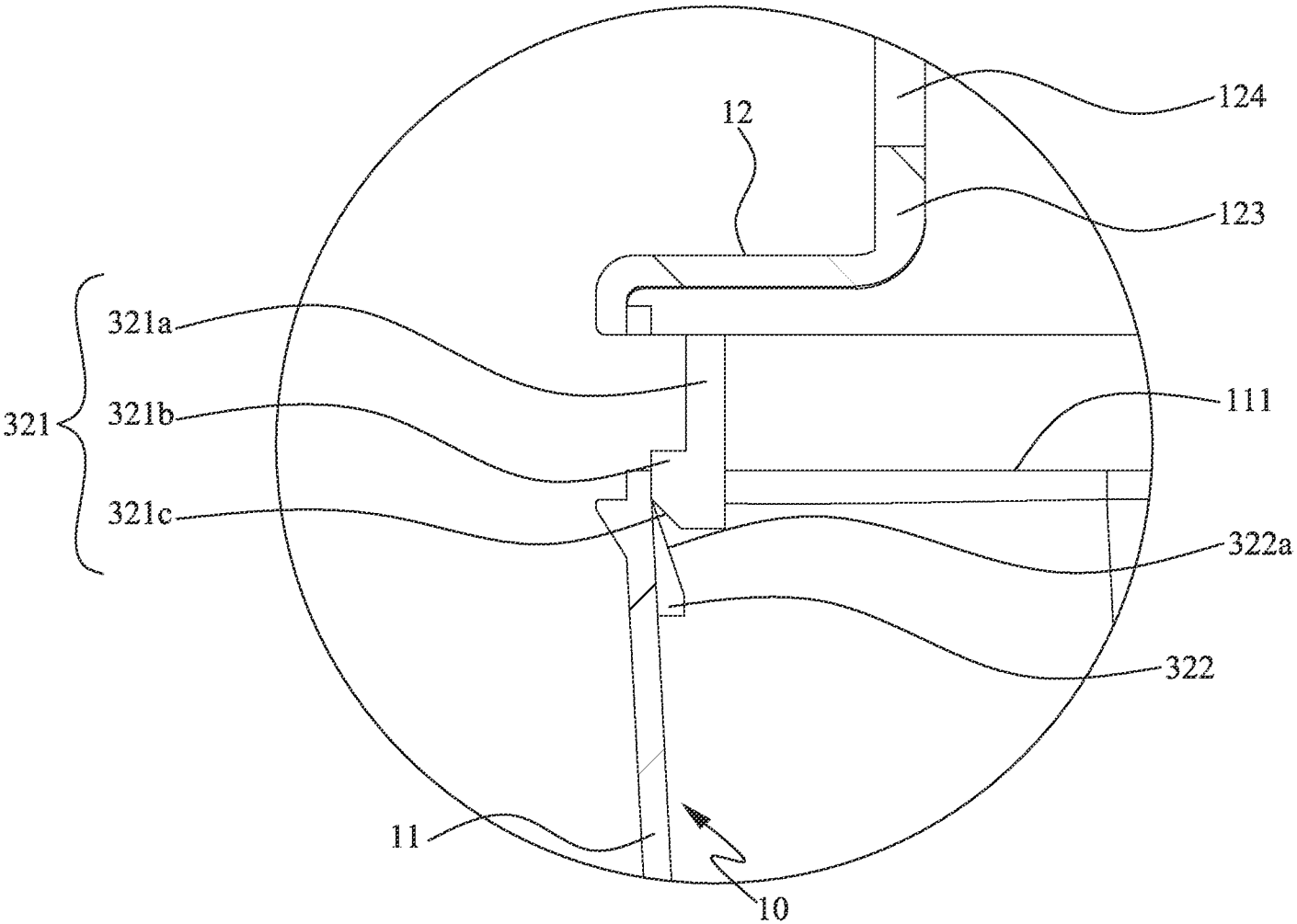
FIG. 9A is a schematic diagram showing an outer snapping hook contacts to an outer snapping block.
Figure 9B:
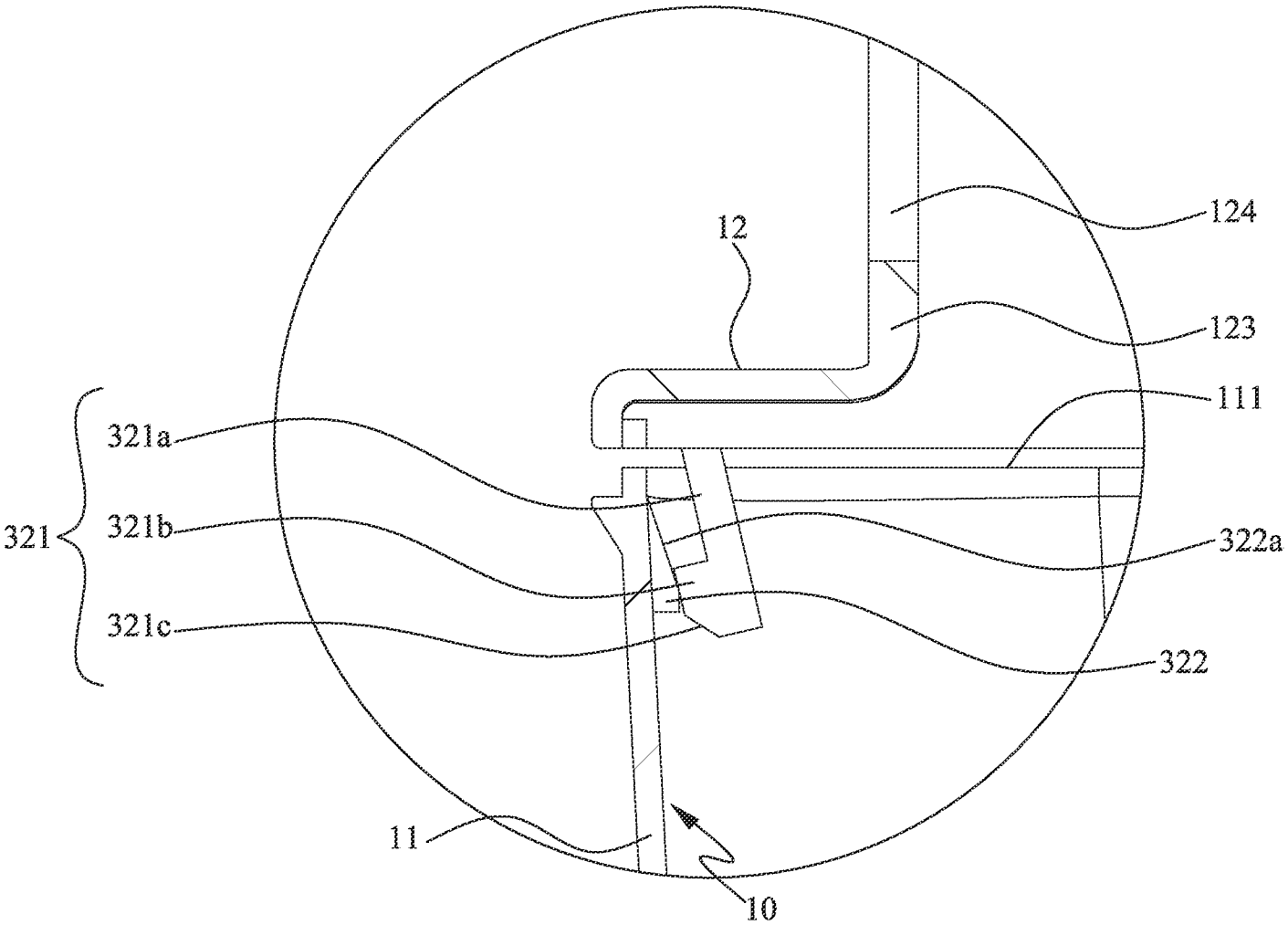
FIG. 9B is a schematic diagram showing the outer snapping hook makes a deformation.
Figure 9C:
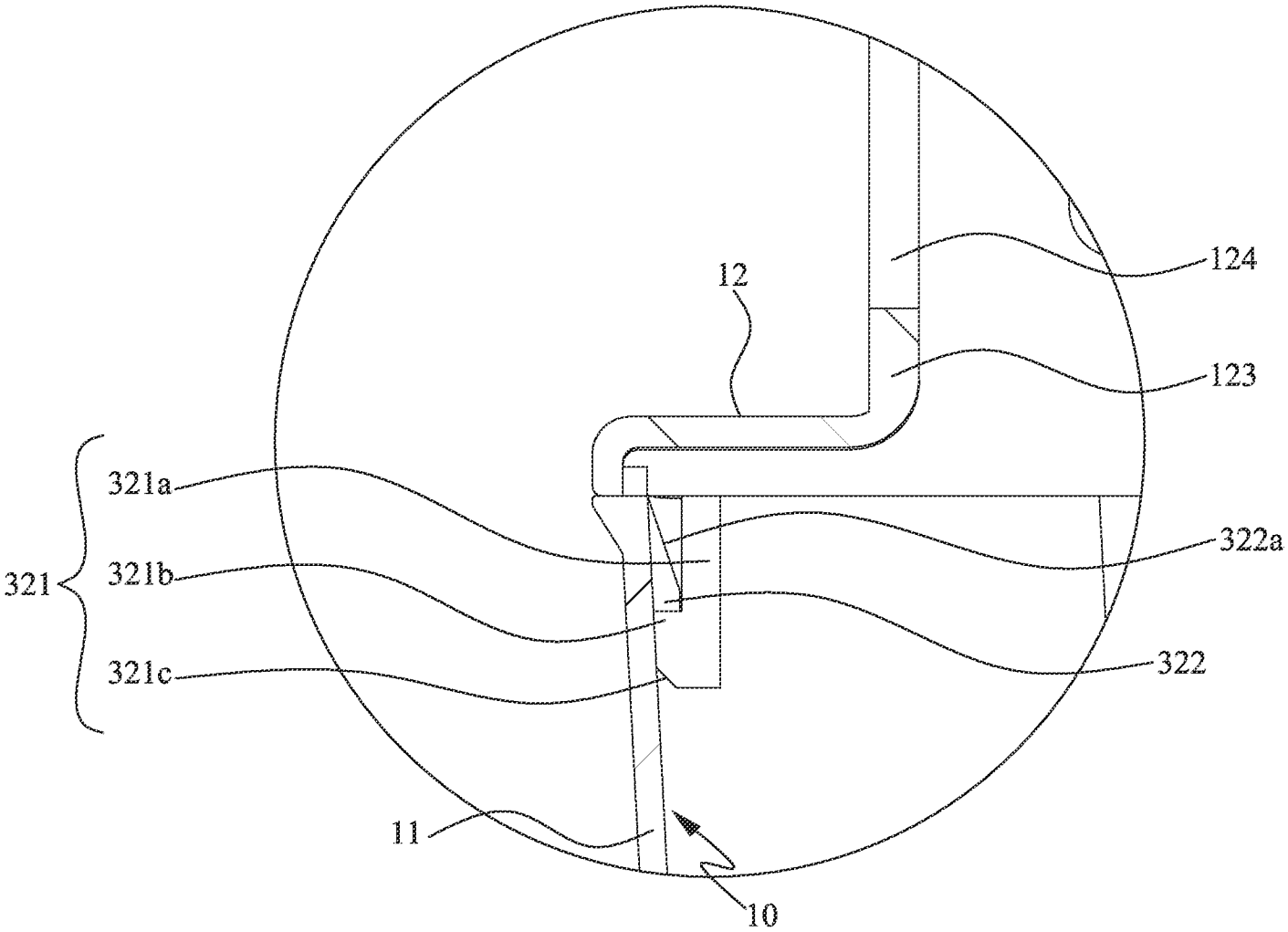
FIG. 9C is a schematic diagram showing the outer snapping hook snaps into the outer snapping block.

Referring to FIG. 9A, FIG. 9B and FIG. 9C, the inner shell 12 of the box 10 penetrates from the opening end 111 of the outer shell 11 to the inside of the outer shell 11, so that the connecting flange 123 of the inner shell 12 gradually approaches the opening end 111 of the outer shell 11, and then the hook guide surface 321*c* of the outer snapping hook 321 will first contacts the block guide surface 322*a* of the outer snapping hook 322, then the inner shell 12 continues to move relative to the outer shell 11 in a state while the hook guide surface 321*c* contacts the block guide surface 322*a*, so that the outer pillaring body 321*a* of the outer snapping hook 321 will deform through the contact of the hook guide surface 321*c* with the block guide surface 322*a*, at the same time, the contact area between the hook guide surface 321*c* and the block guide surface 322*a* will be gradually reduced, and when the hook guide surface 321*c* is not in contact with the block guide surface 322*a*, the outer pillaring body 321*a* will return to the original shape, so that the outer buckling block 321*b* of the outer snapping hook 321 is located below the outer snapping hook 322, thereby, the outer snapping hook 321 is snapped into the outer snapping hook 322.

Figure 10:
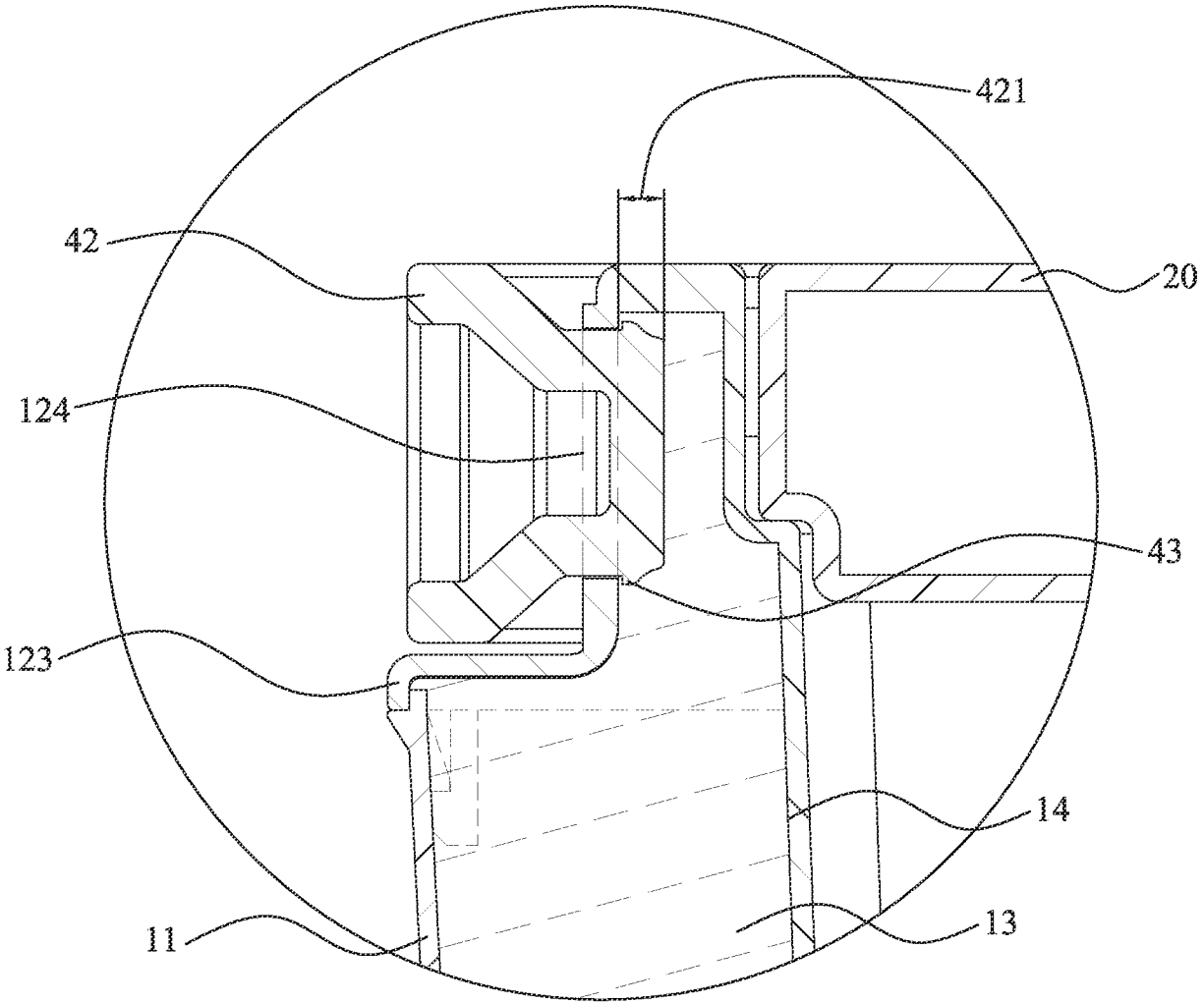
FIG. 10 is a schematic diagram showing a pivoting portion penetrates a pivoting hole.

Referring to FIG. 2, FIG. 3 and FIG. 10, the handle 40 has a grip portion 41 with a U-shaped appearance, and both ends of the grip portion 41 extend respectively to form a pivoting portion 42 with a cylindrical appearance, a contour of the pivoting portion 42 is smaller than the pivoting hole 124 of the box 10, as shown in FIG. 10, the pivoting portion 42 penetrates one of the pivoting holes 124 of the box 10 one-to-one, so that a part of the pivoting portion 42 is disposed as an pin section 421 in the accommodating space 14, wherein the periphery of the pin section 421 protrudes to form a block section 43 with a contour larger than the pivoting hole 124, and the block section 43 can contacts the connecting flange 123 of the inner shell 12, when the handle 40 is swung relative to the box 10, the handle 40 contacts the inner shell 12 through the block section 43 and can avoid being separated from the inner shell 12.

Figure 11:
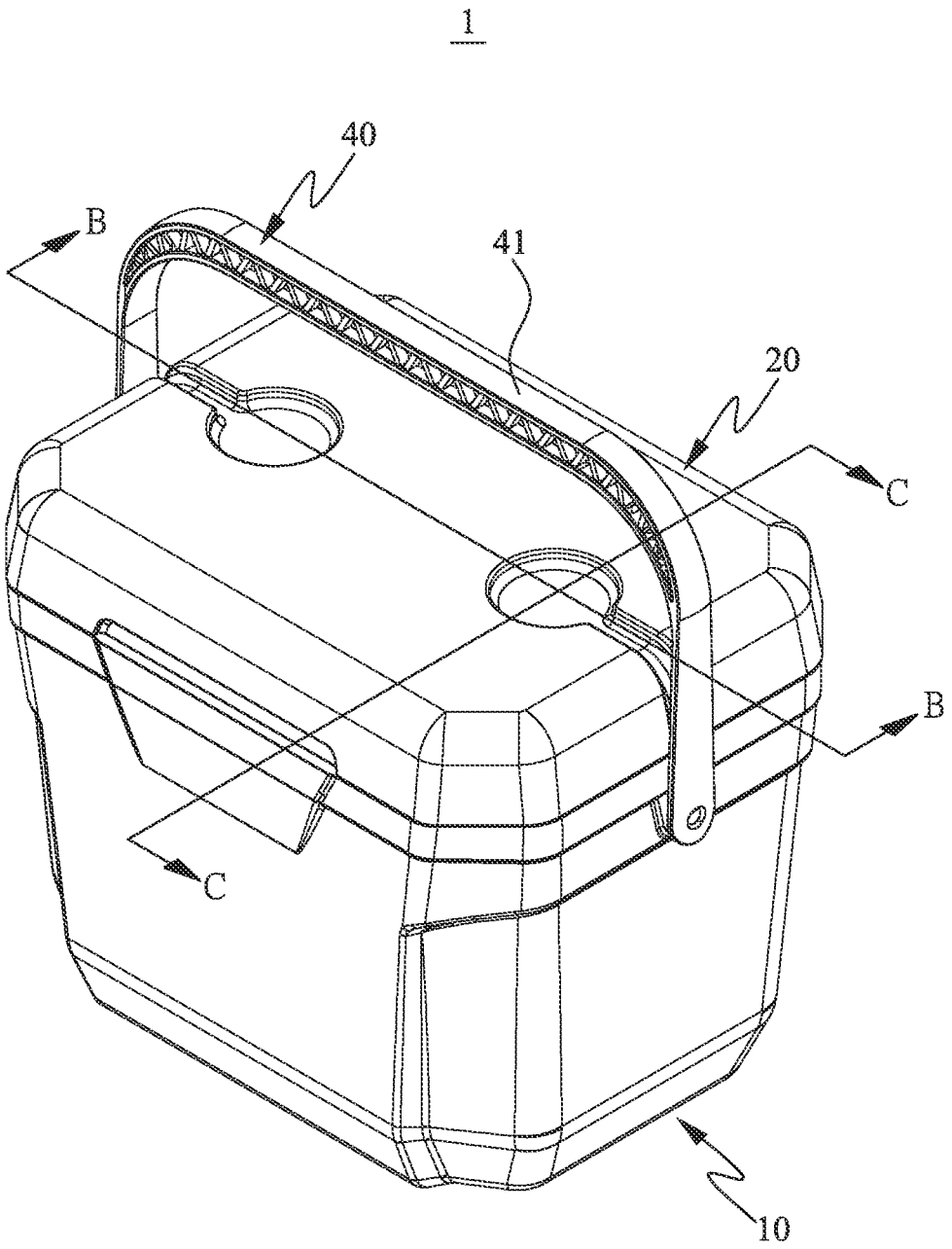
FIG. 11 shows a perspective view of the snap-fit cooler box according to the second preferred embodiment of the present invention.
Figure 12:
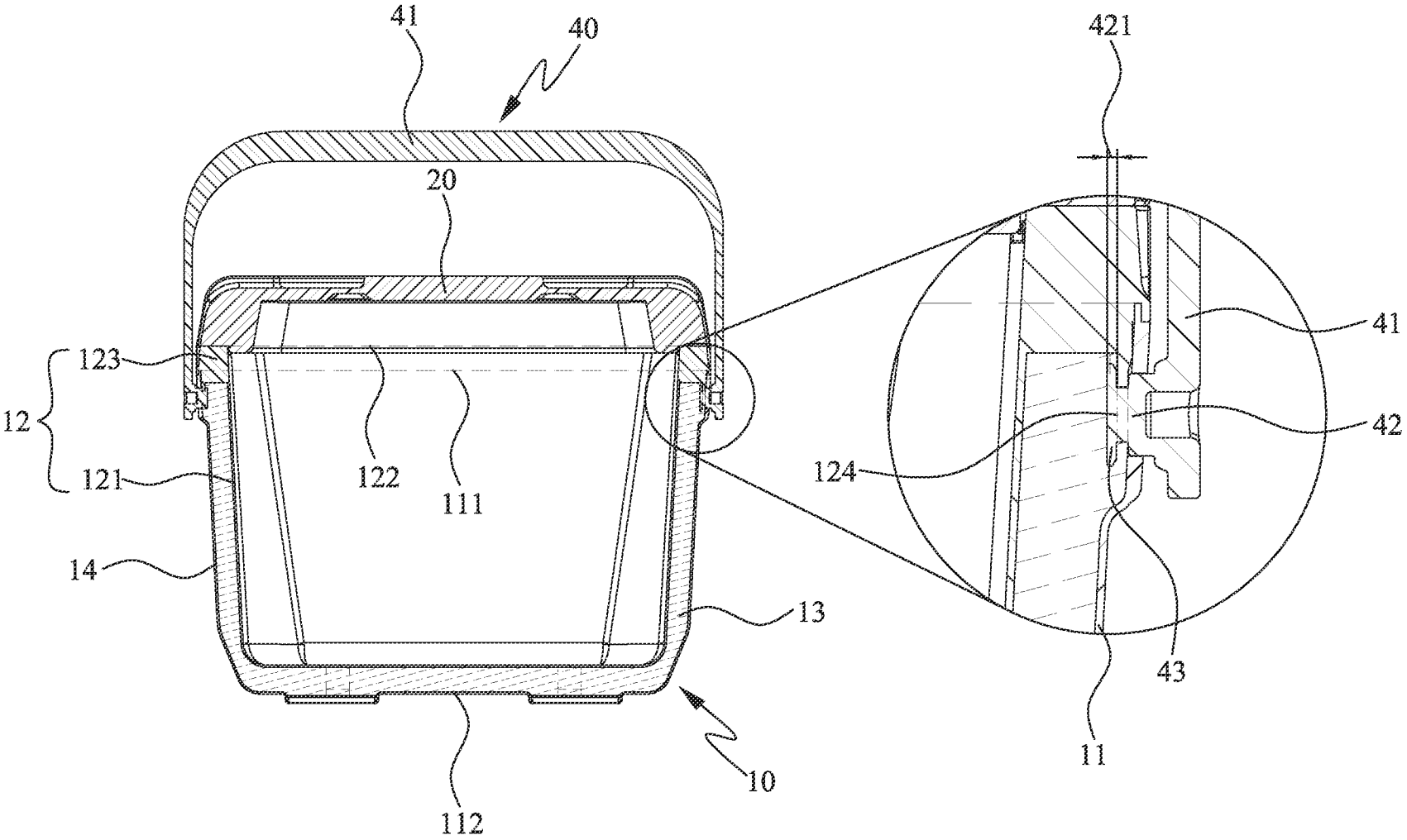
FIG. 12 shows a sectional view of the section B-B in FIG. 11.
Figure 13:
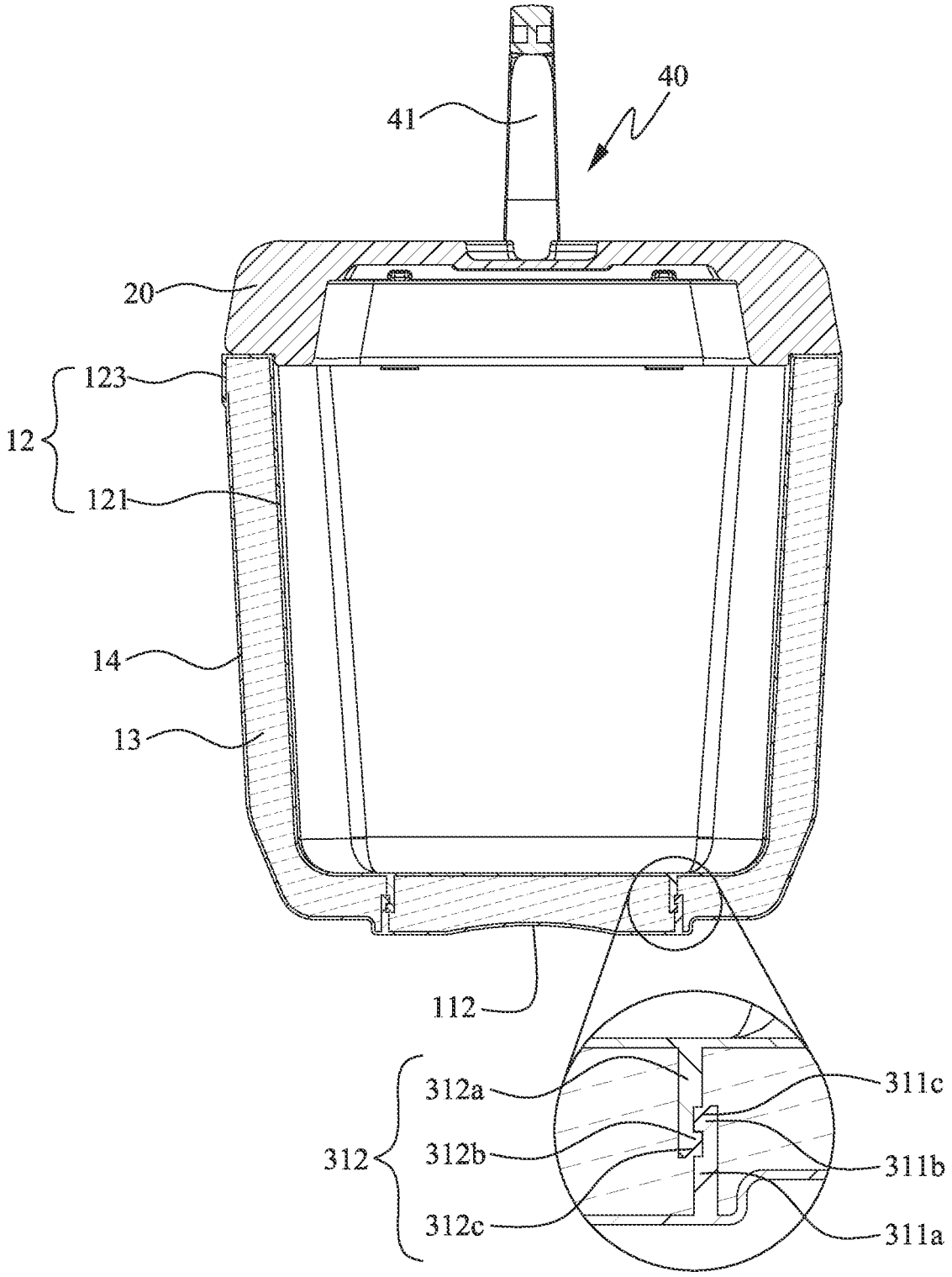
FIG. 13 shows a sectional view of the section C-C in FIG. 11.

Referring to FIG. 11, FIG. 12 and FIG. 13, in the second preferred embodiment, the difference from the first preferred embodiment is in the structural arrangement of the box 10, as for the structures of the cover 20, the snap-fit mechanism 30 and the handle 40 are the same as the first preferred embodiment, and the structures of the cover 20, the snap-fit mechanism 30 and the handle 40 will not be repeatedly described in this embodiment.

As shown in FIG. 12, the pivoting hole 124 of the box 10 is disposed on the outer shell 11 of the box 10, so that the block section 43 of the handle 40 can contacts the outer shell 11, furthermore, as shown in FIG. 13, the accommodating space 14 of the box 10 is filled with the insulating material 13 of the box 10, so that the insulating material 13 can simultaneously contacts the outer shell 11 of the box 10, the inner shell 12 of the box 10 and the inner snap-fit components 31 of the snap-fit mechanism 30, so that the insulating material 13 can be further wrapped around the inner snap-fit components 31.

The above embodiments are only for the convenience of illustrating the present invention and are not intended to limit it. Without departing from the technical scope of the present invention, those skilled in the industry are familiar with various simple deformations and modifications made according to the scope of the patent application of the present invention and the description of the invention. shall still be included in the following patent application scope.

What is claimed is:

1. A snap-fit cooler box, comprising:

an outer shell being formed with a closing end and an opening end located opposite to the closing end;

an inner shell being provided with a container locating inside the outer shell and a connecting flange locating outside the outer shell;

an accommodating space being formed between the outer shell and the inner shell;

an insulating material being located in the accommodating space;

a cover being pivoted with the connecting flange for covering the container;

a plurality of inner snap-fit components, each of the inner snap-fit components includes two inner snapping hooks that are capable of snapping into each other, one of the inner snapping hooks is disposed on the closing end, and another of the inner snapping hooks is disposed on the container; each of the inner snapping hooks includes an inner pillaring body and an inner buckling body extending from the inner pillaring body, and an inner guide surface is formed on the inner buckling body of one of the inner snapping hooks to contact with another inner guide surface on the inner buckling body of the other of the inner snapping hooks; and a plurality of outer snap-fit components are disposed between the opening end and the connecting flange, each of the outer snap-fit components includes an outer snapping block and an outer snapping hook that is capable of snapping into the outer snapping block, a hook guide surface is formed on the outer snapping hook to contact with the outer snapping block.

2. The snap-fit cooler box as claimed in claim 1, wherein a plurality of holes are penetratingly formed in a partial area of the insulating material for accommodating the inner snap-fit components; each of the holes has an inner sidewall surface, and a contour of the hole is larger than the inner snap-fit components, so that the inner sidewall surface is spaced out the inner snap-fit components.

3. The snap-fit cooler box as claimed in claim 1, wherein the accommodating space is filled with the insulating material, so that the insulating material contacts with the outer shell, the inner shell and the inner snap-fit components simultaneously.

4. The snap-fit cooler box as claimed in claim 1, wherein when the inner buckling body of one of the inner snapping hooks contacts another inner buckling body of the other of the inner snapping hooks, the inner pillaring body of the inner snapping hooks are deformed along two opposite directions at the same time.

5. The snap-fit cooler box as claimed in claim 1, wherein a pivoting hole is formed on one of the outer shell and the inner shell for communicating with the accommodating space, and the snap-fit cooler box further comprises a handle, the handle incudes a grip portion and a pivoting portion forming on the grip portion for inserting the pivoting hole, and the pivoting portion is provided with a pin section and a block section; the contour of the pivoting hole is larger than the pin section, and the contour of the pivoting hole is smaller than the block section.

6. The snap-fit cooler box as claimed in claim 1, wherein the inner snap-fit components are arranged in a rectangular pattern, so that a rectangular contour being formed by the inner snap-fit components is smaller than a supporting area of the closing end.

* * * * *